US010638821B2

(12) United States Patent
Hwang

(10) Patent No.: US 10,638,821 B2
(45) Date of Patent: May 5, 2020

(54) JEWELLERY CASE

(71) Applicant: Han Hwang, Eastwood (AU)

(72) Inventor: Han Hwang, Eastwood (AU)

( * ) Notice: Subject to any disclaimer, the term of this patent is extended or adjusted under 35 U.S.C. 154(b) by 0 days.

(21) Appl. No.: 16/317,257

(22) PCT Filed: Jul. 13, 2017

(86) PCT No.: PCT/AU2017/050720
§ 371 (c)(1),
(2) Date: Jan. 11, 2019

(87) PCT Pub. No.: WO2018/018068
PCT Pub. Date: Feb. 1, 2018

(65) Prior Publication Data

US 2019/0150580 A1 May 23, 2019

(30) Foreign Application Priority Data

Jul. 25, 2016 (AU) ..... 2016902905
Apr. 4, 2017 (AU) ..... 2017100374

(51) Int. Cl.

| | |
|---|---|
| ***A45C 11/16*** | (2006.01) |
| ***A47F 7/03*** | (2006.01) |
| ***B65D 43/00*** | (2006.01) |
| ***A44C 19/00*** | (2006.01) |
| ***B65D 79/00*** | (2006.01) |

(52) U.S. Cl.
CPC ..... *A45C 11/16* (2013.01); *A44C 19/00* (2013.01); *A47F 7/03* (2013.01); *B65D 43/00* (2013.01); *B65D 79/00* (2013.01)

(58) Field of Classification Search
CPC ..... A44C 19/00; A45C 11/16; A45C 13/02; A47F 7/03; B65D 6/00; B65D 6/06; B65D 43/00; B65D 43/14; B65D 79/00
USPC ..... 206/6.1, 45.23
See application file for complete search history.

(56) References Cited

U.S. PATENT DOCUMENTS

| | | | | |
|---|---|---|---|---|
| 1,240,671 A | | 9/1917 | Catala | |
| 2,888,136 A | | 5/1959 | La Borde | |
| 3,930,577 A | | 1/1976 | Kortick | |
| 4,493,417 A | * | 1/1985 | Ackeret | G11B 23/023 206/311 |
| 4,732,269 A | * | 3/1988 | Roy | A45C 11/16 206/495 |
| 5,979,661 A | | 11/1999 | Sherman et al. | |
| 6,478,160 B1 | * | 11/2002 | Au | A45C 11/16 206/6.1 |
| 6,681,953 B2 | * | 1/2004 | Au | A45C 11/10 206/301 |
| 2011/2404920 | | 10/2011 | Hinson et al. | |

OTHER PUBLICATIONS

International Search Report and Written Opinion of the International Searching Authority, PCT/AU2017/050720, dated Aug. 8, 2017, 8 pages.

* cited by examiner

*Primary Examiner* — Byron P Gehman
(74) *Attorney, Agent, or Firm* — Sage Patent Group

(57) ABSTRACT

A jewellery case includes a base to which a jewellery mount is pivotally mounted, and a lid slidably coupled to the base. The jewellery mount is designed to temporarily hold a piece of jewellery such as an engagement or wedding ring.

18 Claims, 5 Drawing Sheets

JEWELLERY CASE

CROSS REFERENCE TO RELATED APPLICATIONS

This application is a 35 U.S.C. § 371 national stage application of PCT International Application No. PCT/AU2017/050720 filed on Jul. 13, 2017, which in turn claims foreign priority to Australian Patent Application No. 2017100374, filed on Apr. 4, 2017, and Australian Patent Application No. 2016902905, filed Jul. 25, 2016, the disclosures and content of which are incorporated by reference herein in their entirety.

TECHNICAL FIELD

The present invention relates broadly to a jewellery case and relates particularly, although not exclusively, to a ring case typically for an engagement or wedding ring.

BACKGROUND OF INVENTION

The ubiquitous ring case such as that used for an engagement or wedding ring includes a base for placement of the ring and a hinged lid. The ring is typically inserted in a slot provided in bedding material within the base. The hinged lid includes a relatively large cavity which accommodates the ring on closure of the ring case. For aesthetic appeal the ring case is typically lined internally with velvet. The traditional ring case of this construction suffers from at least the following drawbacks:

1. the ring case is relatively large and bulky making it difficult to discreetly store in a person's trouser pocket;
2. largely by nature of its design, the ring case is relatively unattractive;
3. the ring case being visually unappealing may detract from the actual or perceived value of the ring which it contains.

US patent publication 2011/0240492 by Hinson et al is directed broadly to a low profile ring box. The ring box is constructed with a sliding lid and pivoting ring holder. The ring box is of a relatively complicated construction which pivots the ring holder into a vertical disposition on sliding of the lid to open the ring box. The ring box includes a pull tab which connects between the ring holder and the sliding lid to pivot the ring holder from 0 degrees (horizontal) to 90 degrees (vertical) on sliding of the lid into an open position. The ring box also includes a torsion spring which urges the ring holder back down to its horizontal disposition when the sliding lid is pushed back to the closed position.

SUMMARY OF INVENTION

According to the present invention there is provided a jewellery case comprising:

a base to which a jewellery mount adapted to temporarily hold a piece of jewellery is pivotally mounted;

a lid slidably coupled to the base for movement between an open position for exposing the jewellery which is pivotally moved together with the jewellery mount outward of the base toward an exposed disposition, and a closed position for enclosing the jewellery which is pivotally moved, under the influence of the lid contacting the jewellery mount, inward of the base for containing the jewellery;

biasing means including a spring operatively coupled to the jewellery mount to urge it outward of the base toward the exposed disposition.

Preferably the spring is in the form of a torsion spring mounted about an axle of the jewellery mount. More preferably the axle is integral with the jewellery mount and arranged to engage with the spring to effect pivotal movement of the jewellery mount on sliding movement of the lid to the open position.

Preferably the jewellery case also comprises retarding means operatively coupled to the jewellery mount to retard its pivotal movement outward of the base and toward the exposed disposition. More preferably the retarding means includes a damper, geared arrangement or other mechanical contrivance which provides delayed or slowed rotation of the jewellery mount as the lid approaches the open position wherein the jewellery mount pivots at least in part toward the exposed disposition independent of the lid. Even more preferably the other mechanical contrivance includes another torsion spring.

Preferably the jewellery case further comprises a coupling member detachably mounted to the base and arranged to capture the lid for its sliding movement between the open and closed positions. More preferably the coupling member is fixed to the base and coupled to the lid via lid biasing means arranged to control the sliding movement of the lid between the open and closed positions.

Preferably the base includes an external housing detachably connected to an internal housing to which the jewellery mount is retained for its pivotal mounting. More preferably the axle is in the form of a pair of spigots protruding from the jewellery mount and arranged to be retained by respective of a pair of slots in the internal housing. Even more preferably the internal housing defines a cavity within the base, said cavity configured to contain the jewellery and the jewellery mount on movement of the lid to the closed position.

Preferably the lid includes an outer shell detachably connected to an inner shell which is captured by the coupling member for sliding movement of the lid between the open and closed positions. More preferably the inner shell includes a pair of stop elements designed for abutment with the coupling member on movement of the lid to or proximal the open position and the closed position respectively. Even more preferably the outer shell couples to the coupling member via the lid biasing means which is housed between the inner and the outer shells and provides controlled movement of the lid between the open and closed positions. Still more preferably the lid includes a cover detachably connected to the outer shell to enclose the lid.

Preferably the lid includes a key arranged for sliding engagement with a keyway in the base on movement of the lid between the open and closed positions. More preferably the keyway is in the form of an elongate channel in the internal housing of the base. Even more preferably the key is in the form of a tongue in the outer shell of the lid which slidably engages the elongate channel in the base.

Preferably the jewellery case is a ring case.

BRIEF DESCRIPTION OF DRAWINGS

In order to achieve a better understanding of the nature of the present invention a preferred embodiment of a jewellery case will now be described, by way of example only, with reference to the accompanying drawings in which.

DETAILED DESCRIPTION

Figure 1:
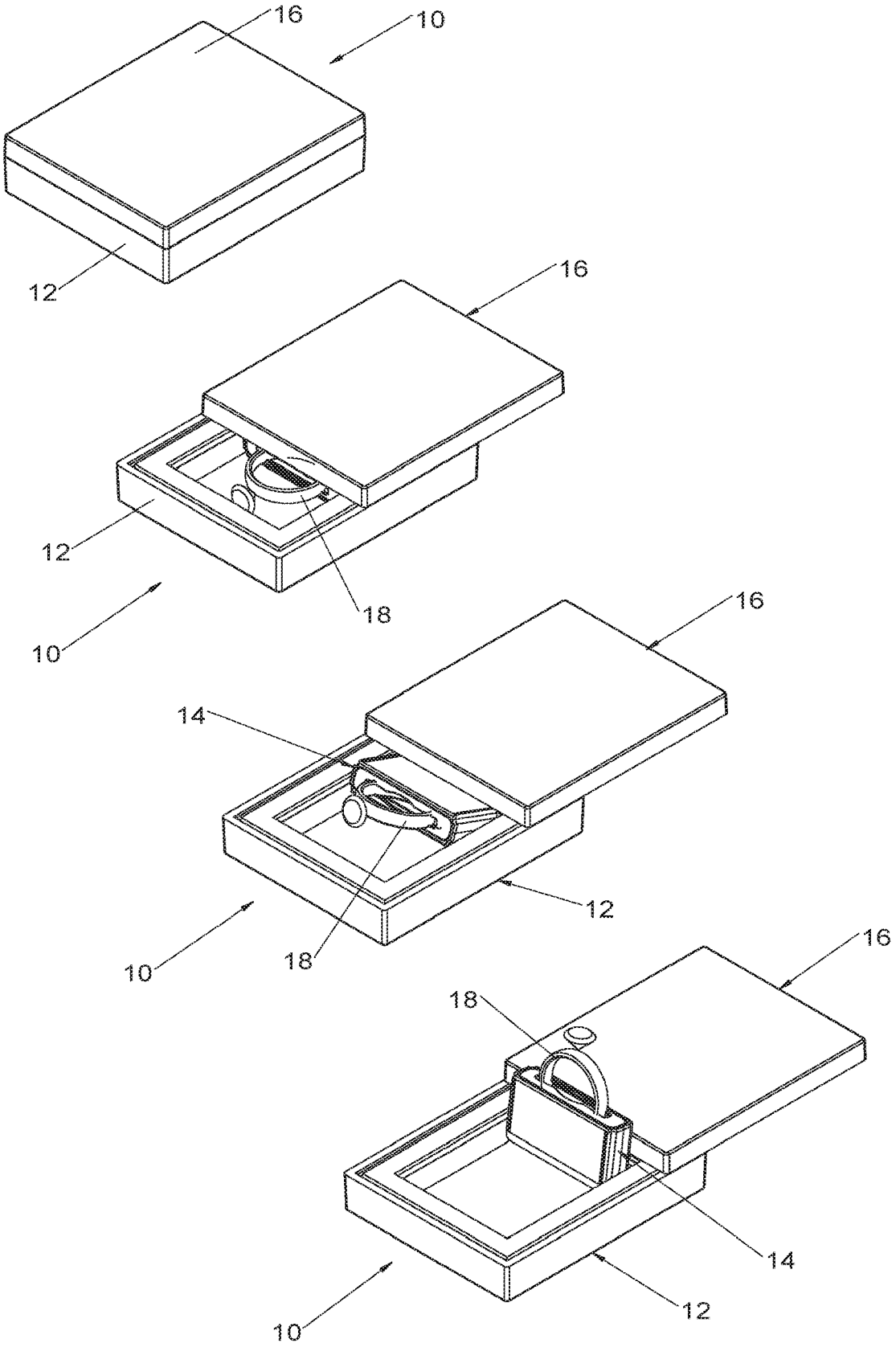
FIG. 1 shows various perspective views of a jewellery case of an embodiment of the invention in the course of the case being progressively opened.
Figure 2:
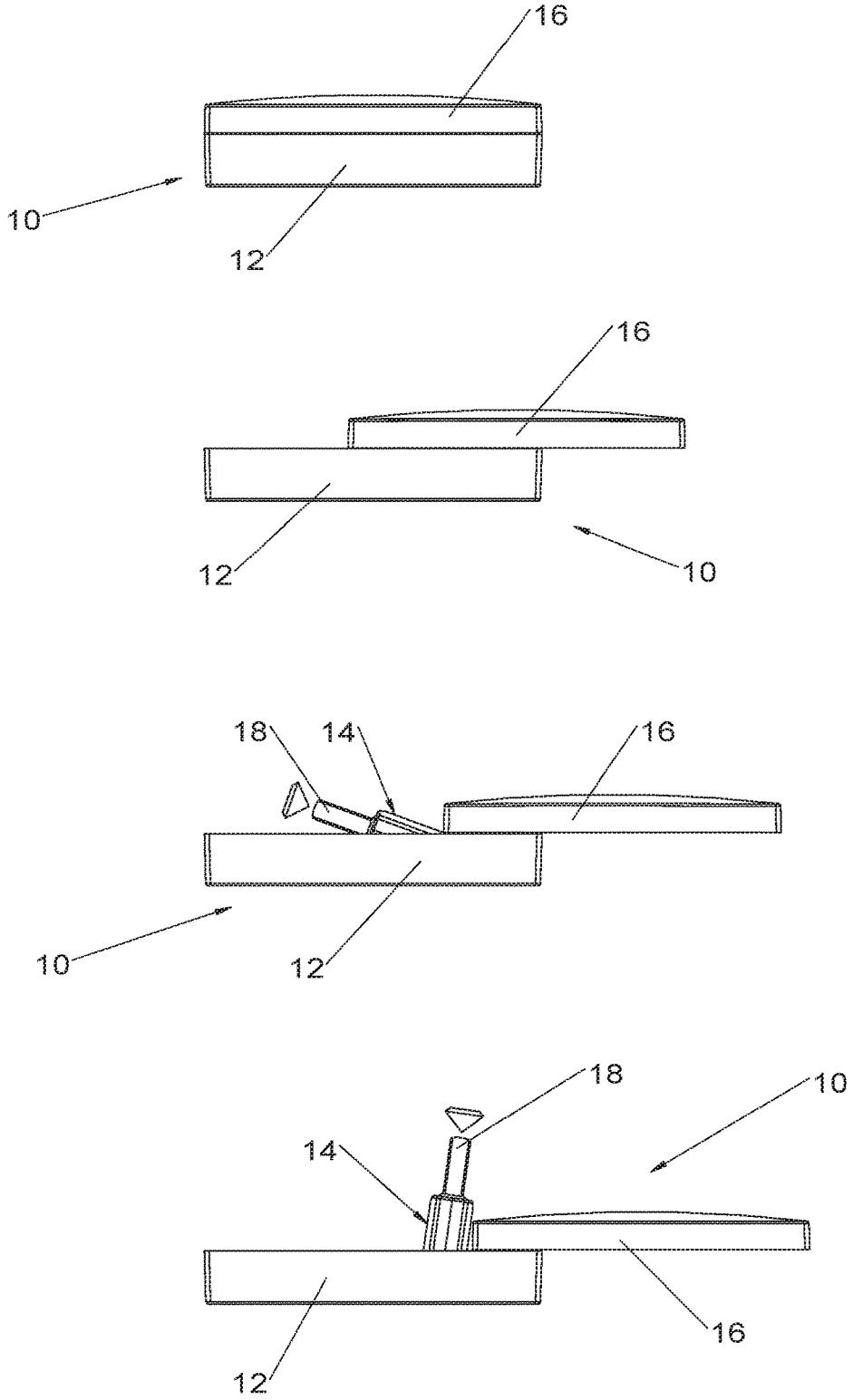
FIG. 2 are side views of the jewellery case of the preferred embodiment of FIG. 1 being progressively opened.
Figure 3:
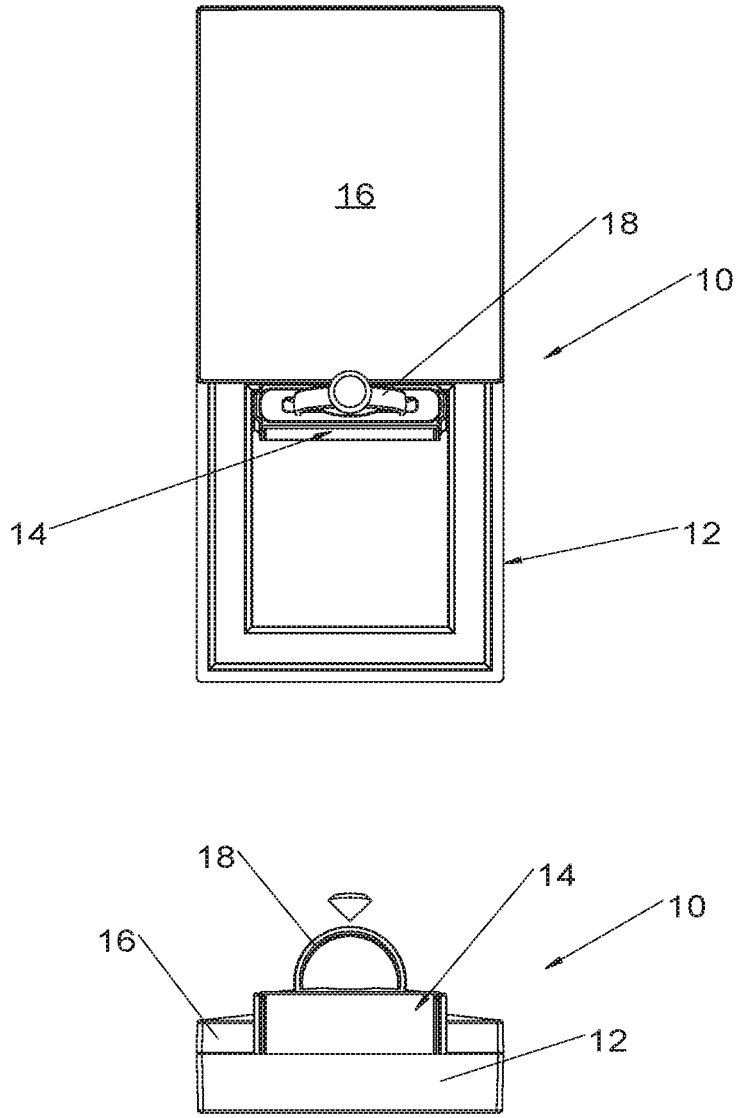
FIG. 3 are plan and end views of the jewellery case of the preferred embodiment of the preceding figures in its open position.

As shown in FIGS. 1 to 3 there is a jewellery case 10 generally comprising a base 12 to which a jewellery mount 14 is pivotally mounted, and a lid 16 slidably coupled to the base 12. The jewellery mount 14 is designed to temporarily hold a piece of jewellery such as an engagement or wedding ring 18.

FIGS. 1 and 2 illustrate operation of the jewellery case 10 where the lid 16 slidably moves relative to the base 12 between an open position and a closed position, see the representations of FIGS. 1 and 2. In the open position in the rightmost and lowermost representations of FIGS. 1 and 2 respectively, the lid 16 exposes the jewellery 18 which is pivotally moved together with the jewellery mount 14 outward of the base 12. In the closed position in the leftmost and uppermost representations of FIGS. 1 and 2 respectively, the lid 16 encloses the jewellery 18 which is pivotally moved, under the influence of the lid 16 contacting the jewellery mount 14, inward of the base 12 for containing the jewellery 18.

Figure 4:
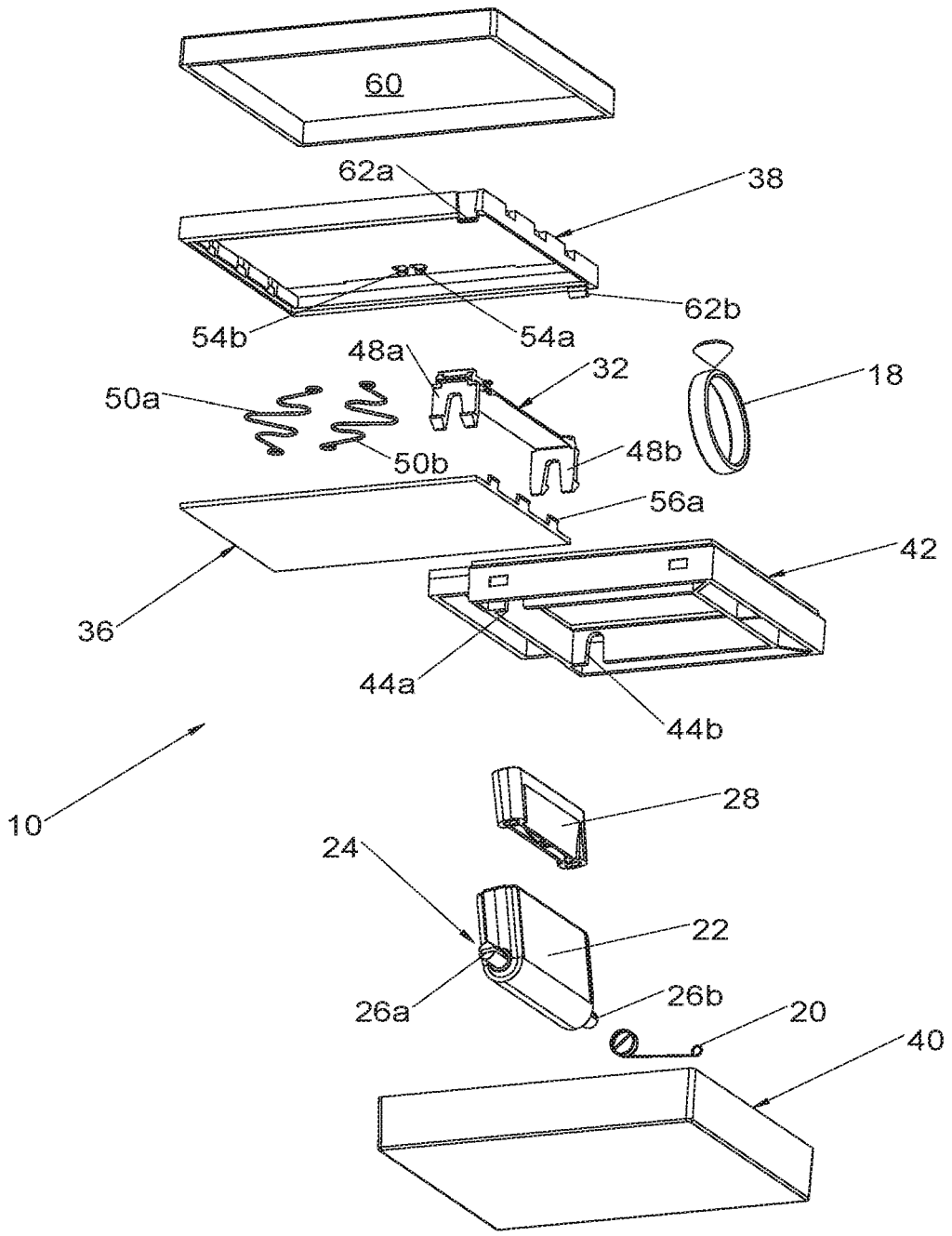
FIG. 4 is an exploded lower perspective view of the jewellery case of the preferred embodiment of the preceding figures.
Figure 5:
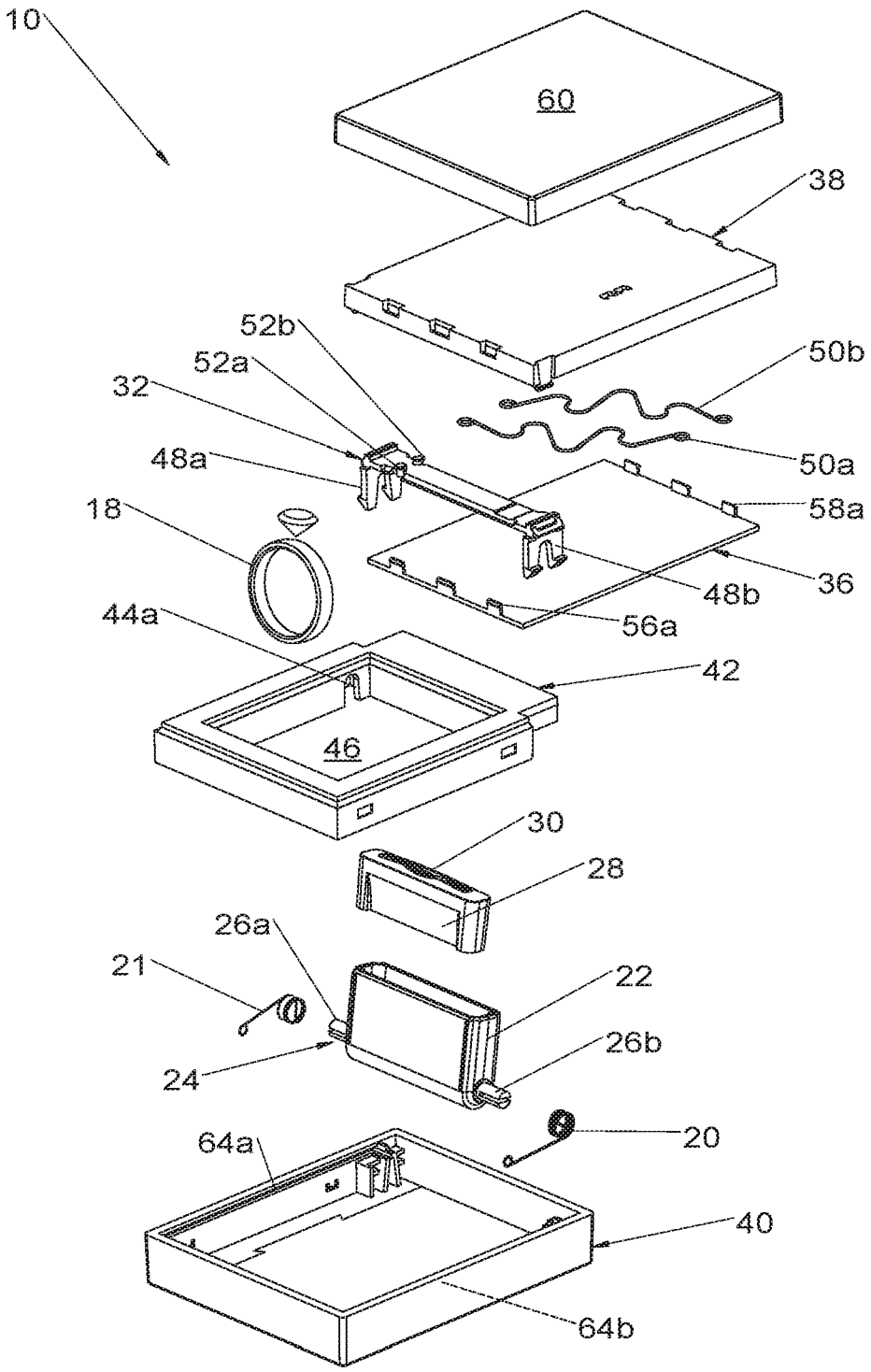
FIG. 5 is an exploded upper perspective view of the jewellery case of the preferred embodiment of the preceding figures.

As shown in the exploded views of FIGS. 4 and 5 the jewellery case 10 also comprises ring mount biasing means in the form of a torsion spring 20 operatively coupled to the jewellery mount 14 to urge it outward of the base 12 toward the open position. The jewellery mount 14 includes a hollow casing 22 having an axle 24 in the form of a pair of spigots 26*a* and 26*b* formed integral with and protruding from the casing 22. The torsion spring 20 engages one of the spigots such as 26*b* of this embodiment. The jewellery mount 14 also includes an inner retainer 28 constructed of a resiliently flexible material and having a slot 30 in which the jewellery 18 is temporarily held.

The jewellery case 10 further comprises a coupling member in the form of rail member 32 detachably mounted to the base 12 and arranged to capture the lid 16 for its sliding movement between the open and closed positions. The lid 16 of this embodiment includes an outer shell 38 detachably connected to an inner shell 36 which is captured by the rail member 32 for sliding movement of the lid 16.

The base 12 of this embodiment includes an external housing 40 detachably connected to an internal housing 42 to which the jewellery mount 14 is retained for its pivotal mounting. In this example the pair of spigots 26*a* and 26*b* of the jewellery mount 14 are retained by respective of a pair of slots 44*a* and 44*b* in the internal housing 42. The internal housing 42 defines a cavity 46 within the base 12 and the cavity 46 is configured to contain the jewellery 18 and the jewellery mount 14 on movement of the lid 16 to the closed position.

The rail member 32 of this embodiment is sandwiched between the inner shell 36 and the outer shell 38 of the lid 16. The rail member 32 includes a pair of feet 48*a* and 48*b* at its respective ends protruding from the lid 16. The feet 48*a* and 48*b* in this example are clipped or otherwise fixed to the external housing 40 of the base 12. The rail member 32 is also coupled to the lid 16 via lid biasing means in the form of a pair of lid springs 50*a* and 50*b* arranged to control the sliding movement of the lid 16 between the open and closed positions. The lid springs 50*a/b* are generally m-shaped and at one end are clipped or otherwise connected to the rail member 32 and at an opposite end clipped or otherwise connected to the outer shell 38 of the lid 16. For this purpose the rail member 32 includes a pair of rail posts 52*a* and 52*b* whereas the outer shell 38 includes a pair of shell posts 54*a* and 54*b*.

In this embodiment the inner shell 36 of the lid 16 includes stop elements such as 56*a* and 58*a* at each of its opposing ends. The stop elements 56*a* and 58*a* are designed for abutment with the rail member 32 on movement of the lid 16 to or proximal the open position and the closed position respectively. In this example the lid 16 also includes a cover 60 detachably connected to the outer shell 38 to enclose the lid 16. The cover 60 may be decorative and designed to be customised so that it functions as a branding fascia.

In this embodiment the lid 16 includes a pair of keys 62*a* and 62*b* arranged for sliding engagement with respective of a pair of keyways 64*a* and 64*b* in the base 12. The keyway such as 64*a* is in the form of an elongate channel in the external housing 40 of the base 12. The key such as 62*a* is in the form of a tongue protruding outwardly from the outer shell 38 of the lid 16 and designed to slidably engage the elongate channel such as 64*a* in the base 12 whilst the lid 16 is moved from the open to the closed positions and vice a versa. In an alternative arrangement, the keys may be directed inward of the outer shell for sliding engagement with respective of outward facing channels in the base.

In operation and as best shown in FIGS. 1 and 2 the jewellery case 10 is closed by sliding the lid 16 into contact with the jewellery mount 14 to pivot it and the associated piece of jewellery 18 inward of the base 12. The lid 16 directly contacts the jewellery mount 14 during this sliding movement and pivots the jewellery mount 14 against the biasing force of the torsion spring 20 or other biasing means. The lid 16 is controlled in its sliding movement between the open and closed positions, under the influence of the lid springs 50*a* and 50*b* or other biasing means, to provide controlled closure of the lid 16. This action is shown in the rightmost to leftmost representations of FIG. 1 and the lowermost to uppermost representations of FIG. 2. It will be appreciated that opening of the jewellery case 10 is in essence a reversal of these steps with the lid 16 being slidably retracted away from the base 12.

The jewellery case 10 of this embodiment is designed so that:

1. the torsion spring 20 or the ring mount biasing means provides substantially the minimum force to urge the jewellery mount 14 upward into its exposed disposition on opening of the lid 16;
2. the lid springs such as 50*a* or other lid biasing means are of sufficient resistance to provide controlled opening and closure of the lid 16 whilst being able to be manipulated by hand with relative ease.

The jewellery case 10 may also comprise retarding means operatively coupled to the jewellery mount 14 to retard its pivotal movement outward of the base 12 toward its exposed disposition. The retarding means may include a damper, geared arrangement, or other mechanical contrivance which provides delayed or slowed rotation of the jewellery mount 14 toward its exposed disposition. In this example the retarding means is in the form of another torsion spring 21 mounted to an opposing of the spigots 26*a* of the jewellery mount 14. This retarding torsion spring 21 is arranged in an opposite rotational direction to the earlier-disclosed torsion spring 20 to provide the slowed or delayed presentation of the jewellery mount 14. In this embodiment the lid 16 may not contact the jewellery mount 14 during the final stage of opening of the lid 16 and the delayed rotation of the jewellery mount 14 to its exposed disposition. The lid 16 and jewellery mount 14 thus function independent of one another as the lid approaches the open position during the final stage of opening of the lid 16. It will be appreciated that this slowed pivoting of the jewellery mount 14 presents the associated piece of jewellery 18 with a sense of delay or anticipation which adds to the moment.

The lid biasing mans, in the form of the lid springs such as 50*a*, biases the lid 16 toward its closed position, This permits automatic closure of the lid 16 and avoids accidental opening of the lid 16 unless it is displaced or slid beyond a threshold position relative to the base 12. The automatic closure of the lid 16 is provided where it is propelled closed under the influence of the lid biasing means beyond the threshold position. The lid biasing means similarly propels the lid 16 toward its open position when it is displaced in an opposite direction beyond the threshold position.

The torsion spring 20 in providing a relatively light torsional force for pivoting of the jewellery mount 14, minimises the upward force presented by contact of the jewellery mount 14 with the lid 16 on its opening and closure. Although the lid 16 is in this embodiment slidably retained to the base 12 via the key such as 62*a* and keyway 64*a* arrangement, excess force in contact between the jewellery mount 14 and the lid 16 for its closure may inhibit its sliding movement. Therefore, achieving the right balance in the torsion or other biasing force of the torsion spring 20 and the resistance force in the lid biasing means such as the lid spring 50*a* is important. For example, excess torsional force in pivoting the jewellery mount 14 may twist the lid 16 about the rail member 32 and inhibit or jam its sliding movement.

Now that a preferred embodiment of a jewellery case has been described it will be apparent to those skilled in the art that it has the following advantages:

1. the jewellery case is relatively slimline and elegant in its presentation of the associated piece of jewellery;
2. the jewellery case is relatively robust in its construction and designed with a reliable sliding mechanism for movement between its open and closed positions;
3. the jewellery case is of a modular construction including components capable of manufacture or fabrication at relatively low cost.

Those skilled in the art will appreciate that the invention as described herein is susceptible to variations and modifications other than those specifically described. For example the jewellery case may include alternative jewellery mount biasing means to a torsion spring provided the jewellery mount is urged outward of the base on sliding movement of the lid to its open position. The lid may be slidably coupled to the base with an alternative arrangement to the coupling member of the preferred embodiment. For example, the lid may be keyed to permit sliding movement across the base without the coupling member and in the absence of any form of lid biasing means to control sliding movement of the lid. All such variations and modifications are to be considered within the scope of the present invention the nature of which is to be determined from the foregoing description.

The invention claimed is:

1. A jewellery case comprising:

a base to which a jewellery mount adapted to temporarily hold a piece of jewellery is pivotally mounted;

a lid slidably coupled to the base for movement between an open position for exposing the jewellery and a closed position for enclosing the jewellery, the jewellery mount being pivotally moved outward of the base toward an exposed disposition where the lid is in the open position, said jewellery mount being pivotally moved, under the influence of the lid contacting the jewellery mount, inward of the base for containing the jewellery where the lid is in the closed position;

a spring operatively coupled to the jewellery mount to urge the jewellery mount outward of the base toward the exposed disposition.

2. A jewellery case as defined in claim 1 wherein the spring is in the form of a torsion spring mounted about an axle of the jewellery mount.

3. A jewellery case as defined in claim 2 wherein the axle is integral with the jewellery mount and arranged to engage with the spring to effect pivotal movement of the jewellery mount on sliding movement of the lid to the open position.

4. A jewellery case as defined in claim 2 wherein the base includes an external housing detachably connected to an internal housing to which the jewellery mount is retained for its pivotal mounting.

5. A jewellery case as defined in claim 4 wherein the axle is in the form of a pair of spigots protruding from the jewellery mount and arranged to be retained by a pair of slots in the internal housing.

6. A jewellery case as defined in claim 4 wherein the internal housing defines a cavity within the base, said cavity configured to contain the jewellery and the jewellery mount on movement of the lid to the closed position.

7. A jewellery case as defined in claim 4 wherein the lid includes a key arranged for sliding engagement with a keyway in the base on movement of the lid between the open and closed positions.

8. A jewellery case as defined in claim 7 wherein the keyway is in the form of an elongate channel in the internal housing of the base.

9. A jewellery case as defined in claim 7 wherein the key is in the form of a tongue in the outer shell of the lid which slidably engages the elongate channel in the base.

10. A jewellery case as defined in claim 1 further comprising a coupling member detachably mounted to the base and arranged to capture the lid for its sliding movement between the open and closed positions.

11. A jewellery case as defined in claim 10 wherein the coupling member is fixed to the base and coupled to the lid via lid springs arranged to control the sliding movement of the lid between the open and closed positions.

12. A jewellery case as defined in claim 11 wherein the lid includes an outer shell detachably connected to an inner shell which is captured by the coupling member for sliding movement of the lid between the open and closed positions.

13. A jewellery case as defined in claim 12 wherein the inner shell includes a pair of stop elements designed for abutment with the coupling member on movement of the lid to or proximal the open position and the closed position respectively.

14. A jewellery case as defined in claim 12 wherein the outer shell couples to the coupling member via the lid springs which are housed between the inner and the outer shells and provides controlled movement of the lid between the open and closed positions.

15. A jewellery case as defined in claim 12 wherein the lid includes a cover detachably connected to the outer shell to enclose the lid.

16. A jewellery case as defined in claim 1 also comprising a retarding mechanical contrivance operatively coupled to the jewellery mount to retard pivotal movement of the jewellery mount outward of the base and toward the exposed disposition.

17. A jewellery case as defined in claim 16 wherein the mechanical contrivance provides delayed or slowed rotation of the jewellery mount as the lid approaches the open position wherein the jewellery mount pivots at least in part toward the exposed disposition independent of the lid.

18. A jewellery case as defined in claim 1 wherein the jewellery case is a ring case.

* * * * *